US009457596B2

(12) United States Patent
Ogawa

(10) Patent No.: US 9,457,596 B2
(45) Date of Patent: Oct. 4, 2016

(54) SHEET FEEDER AND IMAGE FORMING APPARATUS INCLUDING SAME

(71) Applicant: Masato Ogawa, Kanagawa (JP)

(72) Inventor: Masato Ogawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 361 days.

(21) Appl. No.: 13/747,788

(22) Filed: Jan. 23, 2013

(65) Prior Publication Data

US 2013/0221054 A1 Aug. 29, 2013

(30) Foreign Application Priority Data

Feb. 24, 2012 (JP) ..... 2012-039358
Sep. 28, 2012 (JP) ..... 2012-215623

(51) Int. Cl.
*B41J 11/00* (2006.01)
*B41J 29/48* (2006.01)
*B65H 20/02* (2006.01)

(52) U.S. Cl.
CPC ..... *B41J 11/0075* (2013.01); *B41J 29/48* (2013.01); *B65H 20/02* (2013.01); *B65H 2301/4493* (2013.01); *B65H 2301/443246* (2013.01);

(Continued)

(58) Field of Classification Search
CPC ..... B41J 29/48; B41J 11/0075; B41J 15/00; B41J 15/04; B41J 15/16; B41J 11/0095; B65H 2701/1313; B65H 2404/63; B65H 2301/443246; B65H 23/005; B65H 23/08; B65H 2801/36; B65H 2404/70; B65H 2301/5151; B65H 2301/4493; B65H 2553/40; B65H 2553/612; B65H 20/02
USPC ..... 242/563, 564.3, 564.4, 565, 421.2, 242/421.5, 420.6, 420.5, 419.2, 413.2, 566
See application file for complete search history.

(56) References Cited

U.S. PATENT DOCUMENTS 3,596,682 A * 8/1971 Nydam ..... 139/109
5,758,982 A * 6/1998 Yoshida ..... B41J 29/48 242/563

(Continued)

FOREIGN PATENT DOCUMENTS

CN 1861414 11/2006
JP 6-3961 1/1994

(Continued)

OTHER PUBLICATIONS

Chinese official action dated Nov. 27, 2014 in corresponding Chinese patent application No. 2013 10 05 5137.2.

(Continued)

*Primary Examiner* — Sang Kim
*Assistant Examiner* — Nathaniel Adams
(74) *Attorney, Agent, or Firm* — Cooper & Dunham LLP

(57) ABSTRACT

A sheet feeder including a sheet roll constituted of one long continuous sheet wound around a core, a sheet conveyance unit to convey the sheet fed from the sheet roll and including an extreme upstream member that contacts an upper surface of the sheet fed from the sheet roll at an extreme upstream side in a direction of conveyance of the sheet, and a trailing end detector rotatable by contacting the sheet extended between the core of the sheet roll and the extreme upstream member. The trailing end detector detects a trailing end of the sheet roll upon being rotated upward to a position above a line connecting the extreme upstream member and a lowest part of the core of the sheet roll having a minimum diameter usable in the sheet feeder.

7 Claims, 7 Drawing Sheets

(52) U.S. Cl.
CPC ... *B65H2301/5151* (2013.01); *B65H 2404/14* (2013.01); *B65H 2404/63* (2013.01); *B65H 2404/70* (2013.01); *B65H 2553/40* (2013.01); *B65H 2701/1313* (2013.01); *B65H 2801/36* (2013.01)

(56) References Cited

U.S. PATENT DOCUMENTS

| | | | | |
|---|---|---|---|---|
| 6,089,487 | A * | 7/2000 | Imai | B41J 11/002 242/348.4 |
| 6,409,043 | B1 * | 6/2002 | Fujita | B65H 5/24 271/10.03 |
| 7,300,015 | B2 * | 11/2007 | Fukushima | B65H 20/06 242/348.3 |
| 8,857,976 | B2 * | 10/2014 | Nakada | B41J 11/0075 347/104 |
| 2002/0130941 | A1 | 9/2002 | Tanaami | |
| 2005/0206715 | A1 | 9/2005 | Sasaki et al. | |
| 2006/0269348 | A1 | 11/2006 | Nagata | |
| 2008/0095564 | A1 * | 4/2008 | Yada et al. | 400/613 |
| 2011/0044746 | A1 | 2/2011 | Nagata | |
| 2011/0063644 | A1 | 3/2011 | Niihara et al. | |
| 2011/0064497 | A1 | 3/2011 | Niihara et al. | |
| 2011/0211210 | A1 | 9/2011 | Niihara et al. | |
| 2011/0229242 | A1 | 9/2011 | Morinaga et al. | |

FOREIGN PATENT DOCUMENTS

| | | |
|---|---|---|
| JP | 7-28144 | 5/1995 |
| JP | 2006-321130 | 11/2006 |
| JP | 2011-17874 | 1/2011 |
| JP | 2011-46472 | 3/2011 |
| JP | 2011-131434 | 7/2011 |

OTHER PUBLICATIONS

Japanese communication with the dispatch No. 292798 dated Jul. 5, 2016 in connection with corresponding Japanese patent application No. 2012-215623.

* cited by examiner

SHEET FEEDER AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Applications No. 2012-039358, filed on Feb. 24, 2012, and No. 2012-215623, filed on Sep. 28, 2012, both in the Japan Patent Office, the entire disclosures of which are hereby incorporated by reference herein.

BACKGROUND OF THE INVENTION

1. Field of the Invention

Exemplary aspects of the present invention generally relate to a sheet feeder and an image forming apparatus including the sheet feeder.

2. Description of the Related Art

One type of image forming apparatus such as a printer, copier, plotter, facsimile machine, or multifunction device having two or more of these capabilities is an inkjet recording device employing a liquid ejection recording method. The inkjet recording device includes a recording head constructed of a liquid ejection head that ejects droplets of a recording liquid such as ink onto a recording medium to form an image on the recording medium.

The recording medium is often paper or the like fed from a sheet roll, constituted as one long continuous sheet wound around a core.

Also known is a detector that detects a trailing end of the recording medium roll. One example of the detector is retractably movable relative to a film roll, constituted as one long continuous film wound around a core. Film fed from the film roll is guided by a guide member, and as the film is fed out and an outer circumference of the film roll is reduced, the detector is moved forward to a position overlapping the film roll, without interfering with the rotation of the film roll, to detect the trailing end of the film roll.

With regard to types of sheet rolls, a 2-inch core and a 3-inch core are commonly used. In addition, in some sheet rolls, the trailing end is bonded to the core with glue or the like (hereinafter referred to as bonded sheet rolls), whereas in other sheet rolls, the sheet is merely wound around the core without the trailing end thereof being fixed to the core (hereinafter referred to as unbonded sheet rolls).

In a case in which both types of sheet rolls are usable, the trailing end of the unbonded sheet roll may contact or approach a detection member provided for detecting the trailing end of the bonded sheet roll. Consequently, the trailing end of the unbonded sheet roll may be erroneously detected as the trailing end of the bonded sheet roll even when the bonded sheet roll has not come to its end yet.

In particular, because a detection position where the trailing end of the bonded sheet roll with a relatively larger core is detected is close to a position where the trailing end of the unbonded sheet roll with a relatively smaller core is separated from the core, possibility of erroneous detection is increased.

SUMMARY OF THE INVENTION

In view of the foregoing, illustrative embodiments of the present invention provide a novel sheet feeder in which a sheet roll wound around a core of various sizes can be used, regardless of whether a trailing end of the sheet roll is bonded, temporarily bonded, or unbonded to the core. In a case in which a bonded sheet roll with the trailing end thereof bonded to the core is used, the sheet feeder can reliably detect the trailing end of the bonded sheet roll.

Illustrative embodiments of the present invention also provide a novel image forming apparatus including the sheet feeder.

In one illustrative embodiment, a sheet feeder includes a sheet roll constituted of one long continuous sheet wound around a core, a sheet conveyance unit to convey the sheet fed from the sheet roll and including an extreme upstream member that contacts an upper surface of the sheet fed from the sheet roll at an extreme upstream side in a direction of conveyance of the sheet, and a trailing end detector rotatable by contacting the sheet extended between the core of the sheet roll and the extreme upstream member. The trailing end detector detects a trailing end of the sheet roll upon being rotated upward to a position above a line connecting the extreme upstream member and a lowest part of the core of the sheet roll having a minimum diameter usable in the sheet feeder.

In another illustrative embodiment, an image forming apparatus includes the sheet feeder described above.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
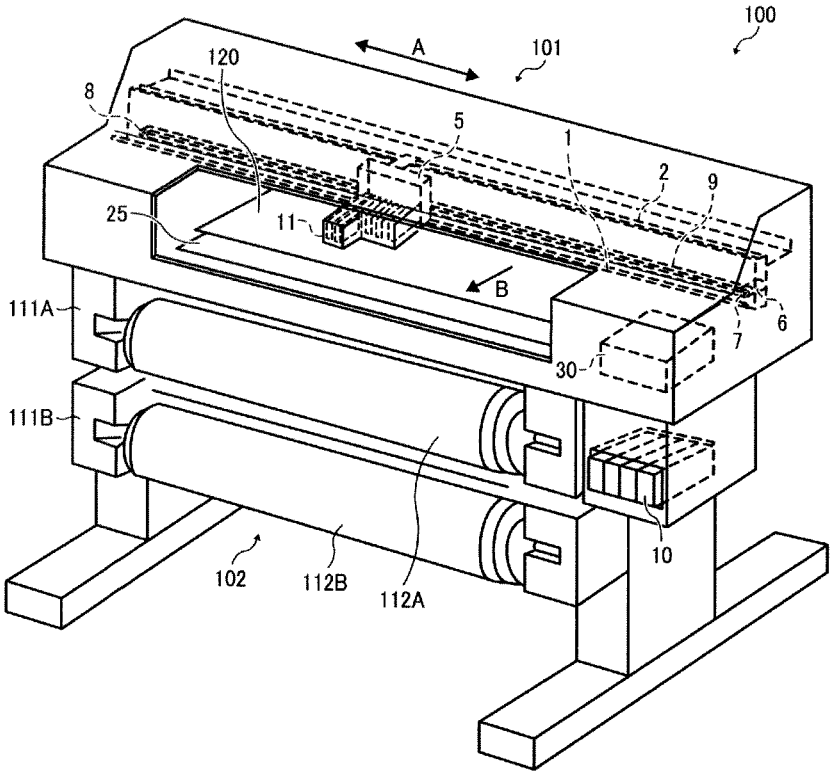
FIG. 1 is a perspective view illustrating an example of an outer appearance of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which liquid droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Figure 2:
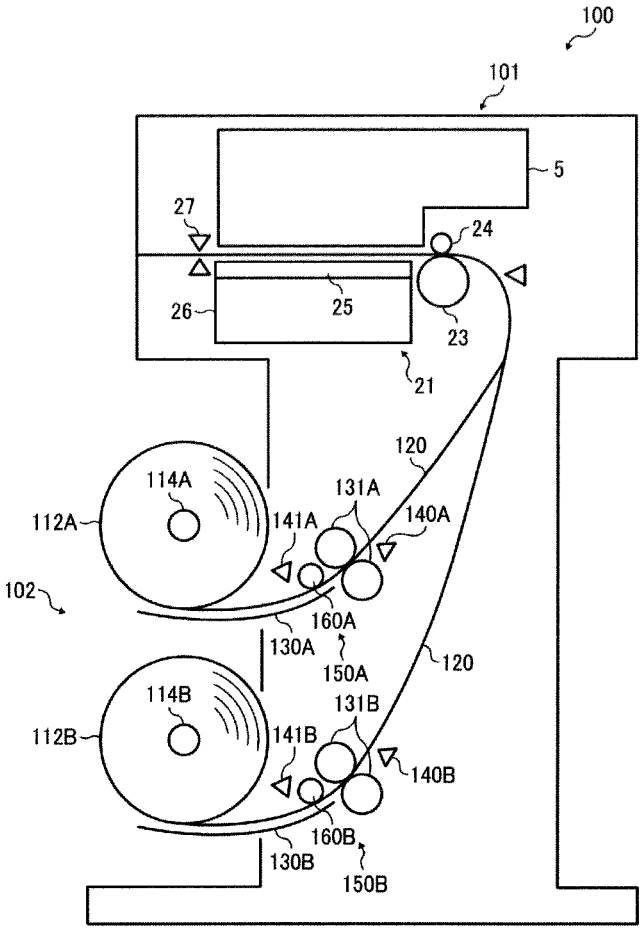
FIG. 2 is a vertical cross-sectional view illustrating an example of a configuration of the image forming apparatus illustrated in FIG. 1.
Figure 3:
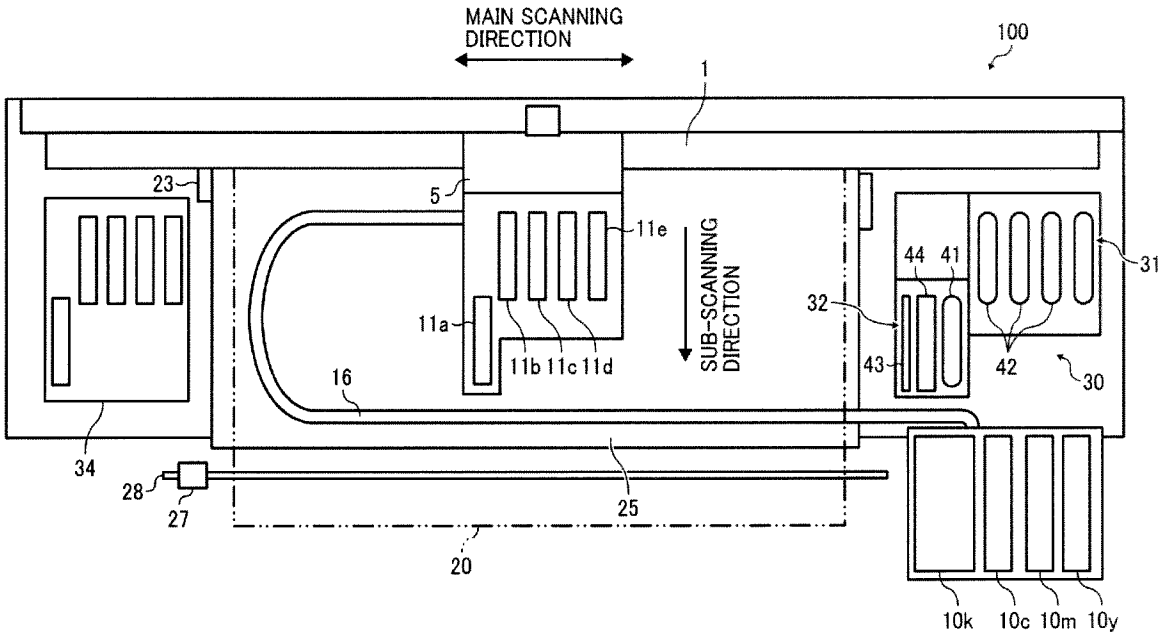
FIG. 3 is a schematic plan view illustrating an example of a configuration of a mechanical portion of the image forming apparatus illustrated in FIG. 1.

A description is now given of a configuration and operation of an image forming apparatus 100 according to a first illustrative embodiment, with reference to FIGS. 1 to 3. FIG. 1 is a perspective view illustrating an example of an outer appearance of the image forming apparatus 100 according to the first illustrative embodiment. FIG. 2 is a vertical cross-sectional view illustrating an example of a configuration of the image forming apparatus 100 illustrated in FIG. 1. FIG. 3 is a schematic plan view illustrating an example of a configuration of a mechanical portion of the image forming apparatus 100.

The image forming apparatus 100 is a serial-type inkjet recording device and includes a body 101 and a sheet feeder 102 disposed below the body 101.

In the body 101 of the image forming apparatus 100, a carriage 5 is slidably held by a guide rod 1 and a guide stay 2, each extended between lateral plates of the image forming apparatus 100, so that the carriage 5 is reciprocally movable back and forth in a main scanning direction indicated by double-headed arrow A in FIG. 1.

A main scanning mechanism that reciprocally moves the carriage 5 in the main scanning direction is constructed of a main scanning motor 6 provided at one end of the image forming apparatus 100 in the main scanning direction, a drive pulley 7 rotatively driven by the main scanning motor 6, a driven pulley 8 provided at the other end of the image forming apparatus 100 in the main scanning direction, and a timing belt 9 extended between the drive pulley 7 and the driven pulley 8.

Recording heads 11*a*, 11*b*, 11*e*, 11*d*, and 11*e* (hereinafter collectively referred to as recording heads 11), each constituted of a liquid ejection head that ejects ink droplets of a specific color, that is, black (K), yellow (Y), magenta (M), or cyan (C), and a head tank, not shown, that supplies ink to the corresponding liquid ejection head, are mounted on the carriage 5. Nozzle arrays each constituted of multiple nozzles are provided to a nozzle face of each of the liquid ejection heads and arrayed in a sub-scanning direction perpendicular to the main scanning direction, such that the recording heads 11 eject link droplets of the specified colors vertically downward.

The recording head 11*a* is offset from the rest of the recording heads 11*b* to 11*e* by a single nozzle array in the sub-scanning direction. Two nozzle arrays are formed in each of the recording heads 11. Black ink droplets are ejected from the recording heads 11*a* and 11*b*, and magenta, cyan, and yellow ink droplets are ejected from the recording heads 11*c*, 11*d*, and 11*e*, respectively.

During monochrome image formation, the recording heads 11*a* and 11*b* are used so that an image with a total length of two recording heads 11*a* and 11*b* in the sub-scanning direction can be formed by a single reciprocal movement of the carriage 5 in the main scanning direction. During full-color image formation, for example, the recording heads 11*b*, 11*c*, 11*d*, and 11*e* are used.

Ink is supplied from ink cartridges 10*k*, 10*c*, 10*m* or 10*y* (hereinafter collectively referred to as ink cartridges 10), each detachably attachable to the body 101 of the image forming apparatus 100, to the head tanks included in the recording heads 11 through a supply tube 16. At this time, black ink is supplied from the ink cartridge 10*k* to both the recording heads 11*a* and 11*b*, respectively.

The carriage 5 has a main scanning range through which it scans, and within this range is a recording range. A sheet 120 fed from the sheet feeder 102 is intermittently conveyed to the recording range by a conveyance part 21 in a sheet conveyance direction indicated by arrow B in FIG. 1. The sheet conveyance direction is perpendicular to the main scanning direction of the carriage 5 and identical to the sub-scanning direction.

The conveyance part 21 includes a conveyance roller 23 that conveys the sheet 120 fed from the sheet feeder 102, a pressing roller 24 provided opposite the conveyance roller 23, a conveyance guide member 25 in which multiple suction holes are formed, and a suction fan 26. The sheet 120 conveyed by the conveyance roller 23 is sucked by the suction fan 26 through the suction holes formed in the conveyance guide member 25.

As illustrated in FIG. 2, a cutter 27 that cuts the sheet 120, on which an image is formed by the recording heads 11, to a predetermined length is disposed downstream from the conveyance part 21 in the sheet conveyance direction.

Although being mounted on a timing belt 28 in the present illustrative embodiment, alternatively, the cutter 27 may be fixed to a wire. The timing belt 28 is wound around a drive pulley driven by a drive motor, not shown, and a driven pulley, and is moved in the main scanning direction by the drive motor via the drive pulley so that the cutter 27 cuts the sheet 120 to the predetermined length.

A maintenance/recovery mechanism 30 that maintains the nozzles of the recording heads 11 is provided next to the conveyance guide member 25 at one end of the image forming apparatus 100 in the main scanning direction. An ink receiver 34 to which ink droplets not used for image formation are ejected in order to remove viscous ink from the nozzles is provided next to the conveyance guide member 25 at the other end of the image forming apparatus 100 in the main scanning direction.

The maintenance/recovery mechanism 30 includes a first unit 31 held by a frame of the body 101 of the image forming apparatus 100 and a second unit 32 movably held by a frame of the maintenance/recovery member 30. The second unit 32 is reciprocally movable back and forth in the sub-scanning direction. During maintenance/recovery of the recording head 11*a*, the second unit 32 is at a position as illustrated in FIG. 3. During maintenance/recovery of the recording heads 11*b* to 11*e*, the second unit 32 is moved in the sub-scanning direction to a position of the first unit 31.

The maintenance/recovery mechanism 30 further includes a suction cap 41 and moisture caps 42, each of which covers the nozzle face of each of the recording heads 11, a wiper 43 that wipes off the nozzle face, and an ink receiver 44 to which ink droplets not used for image formation are ejected in order to remove viscous ink from the nozzles. It is to be noted that the suction cap 41 functions also as a moisture cap.

The sheet feeder 102 includes an upper spool bearing stand 111A and a lower spool bearing stand 111B disposed one above the other (hereinafter collectively referred to as spool bearing stands 111). It is to be noted that, in FIGS. 1 and 2, suffixes A and B refer to components for the upper and lower spool bearing stands 111A and 111B, respectively. Because both the upper and lower spool bearing stands 111A and 111B have the same basic configuration, suffixes A and B are omitted in the description below. Each spool bearing stand 111 includes a mechanism that feeds the sheet 120 from a sheet roll 112 accommodated within the spool bearing stand 111 and rewinds the sheet 120 fed from the sheet roll 112.

The sheet roll 112 is constituted as one long continuous sheet 120 wound around a core 114.

It is to be noted that the spool bearing stands 111 can accommodate both types of the sheet roll 112, in which a trailing end thereof is bonded to the core 114 with glue or the like (hereinafter referred to as bonded sheet roll) and the sheet roll 112 in which the trailing end thereof is not fixed to the core 114 (hereinafter referred to as unbonded sheet roll).

The sheet roll 112 set to the spool bearing stand 111 is rotated to feed the sheet 120 along a guide member 130 disposed downstream from the spool bearing stand 111.

A pair of conveyance rollers 131 is provided downstream from the spool bearing stand 111, and the sheet 120 fed from the sheet roll 112 is curved and conveyed upward by the pair of conveyance rollers 131. A driven roller 160 that contacts an upper surface of the sheet 120 fed from the sheet roll 112 to be rotated as the sheet 120 is conveyed is provided between the spool bearing stand 111 and the pair of conveyance rollers 131. The guide member 130, also disposed between the spool bearing stand 111 and the pair of conveyance rollers 131, guides the sheet 120 to the pair of conveyance rollers 131 from below the sheet 120.

While being conveyed, the sheet 120 fed from the sheet roll 112 by rotation of the pair of conveyance rollers 131 is extended between the sheet roll 112 and the pair of conveyance rollers 131 via the driven roller 160. After passing through the pair of conveyance rollers 131, the sheet 120 is further conveyed between the conveyance roller 23 and the pressing roller 24 in the conveyance part 21.

In the image forming apparatus 100, the sheet 120 fed from the sheet feeder 102 is intermittently conveyed by the conveyance part 21. The recording heads 111 are driven based on image data while the carriage 5 is moved in the main scanning direction so that ink droplets are ejected from the recording heads 11 onto the sheet 120, which remains stationary, to form a single line of an image to be formed on the sheet 120. Thereafter, the conveyance part 21 conveys the sheet 120 by a predetermined amount to form the next line of the image. The above-described processes are repeated to form the image on the sheet 120. The sheet 120 having the image formed thereon is then cut to a predetermined length by the cutter 27 and is discharged to a discharge tray, not shown, provided on the front side of the body 101 of the image forming apparatus 100.

The image forming apparatus 100 further includes an unbonded-trailing end detector 140 provided downstream from the pair of conveyance rollers 131 to detect the trailing end of the sheet 120 for the unbonded sheet roll 112, and a trailing end detector, which, in the present illustrative embodiment, is a bonded-trailing end detector 141 provided upstream from the driven roller 160 to detect the trailing end of the sheet 120 for the bonded sheet roll 112.

In the present illustrative embodiment, the guide member 130, the driven roller 160, and the pair of conveyance rollers 131 together form a sheet conveyance unit 150 that conveys the sheet 120, and of these the driven roller 160 contacts the upper surface of the sheet 120 at the extreme upstream side. Alternatively, in place of the driven roller 160, a rod or a guide member may be used as an extreme upstream member that contacts the upper surface of the sheet 120 at the extreme upstream side.

The unbonded-trailing end detector 140 is constructed of an optical sensor or the like and detects the trailing end of the unbonded sheet roll 112 based on a change in the amount of light detected after the trailing end has passed the optical sensor.

Figure 4:
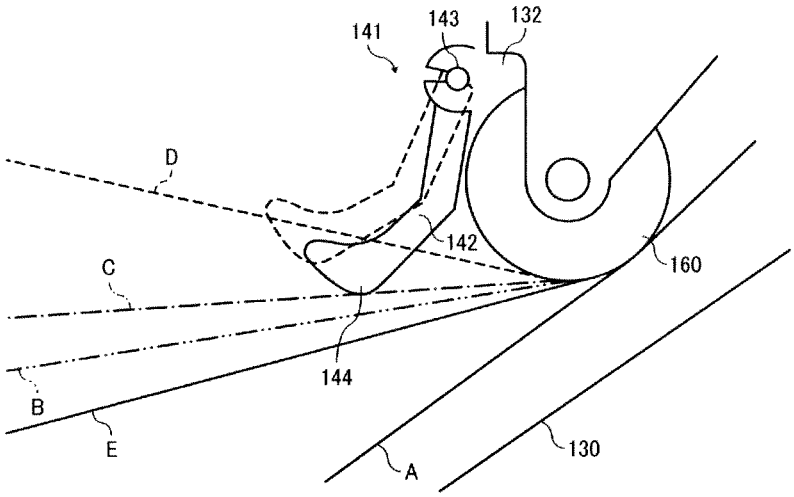
FIG. 4 is an enlarged partial view illustrating an example of a configuration of a bonded-trailing end detector according to the first illustrative embodiment.

A description is now given of the bonded-trailing end detector 141 with reference to FIG. 4. FIG. 4 is an enlarged partial view illustrating an example of a configuration of the bonded-trailing end detector 141 according to the first illustrative embodiment.

The bonded-trailing end detector 141 is provided upstream from the driven roller 160, which is the extreme upstream member that contacts the upper surface of the sheet 120 fed from the sheet roll 112 at the extreme upstream side, and includes a lever 142 rotatable about a rotary shaft 143 by contact with the sheet 120 stretched taut between the core 114 of the sheet roll 112 and the driven roller 160.

As described above, the lever 142 has its center of rotation at the rotary shaft 143, which is itself rotatably supported by a support member 132 that also supports the driven roller 160, and a detection member 144 provided upstream from the rotary shaft 143 to contact the sheet 120.

Although not shown, the lever 142 further includes a detection part that detects that the lever 142 is rotated by a predetermined amount or greater. The detection part, which may be implemented as a switch or an optical sensor, detects the trailing end of the sheet roll 112 when the lever 142 is rotated by the predetermined amount or greater.

Detection of the trailing end of the bonded sheet roll 112 using the bonded-trailing end detector 141 is described in detail below.

During normal sheet feeding, the sheet 120 is guided from an outer circumference of the sheet roll 112 to the pair of conveyance rollers 131 via the driven roller 160 in a state indicated by a line A in FIG. 4, so that the detection member 144 of the lever 142 does not contact the sheet 120.

As the sheet roll 112 approaches its end, the position of the sheet 120 extended between the outer circumference of the sheet roll 112 and the driven roller 160 shifts upward. When the sheet roll 112 reaches its end, the sheet 120 is stretched taut between the core 114 and the driven roller 160, so that a bonded position where the trailing end of the sheet roll 112 is bonded to the core 114 is positioned above the driven roller 160 and thus the sheet 120 is positioned at an end line D in FIG. 4.

At this time, the sheet 120 contacts the detection member 144 of the lever 142 so that the lever 142 is rotated upward. The trailing end of the sheet roll 112 is detected when the lever 142 is rotated upward to a position indicated by a broken line (hereinafter referred to as trailing end detection position) from a position indicated by a solid line in FIG. 4. It is to be noted that the lever 142 is at the trailing end detection position when the sheet 120 is at an intermediate position between the end line D and a line C in FIG. 4, which is described in detail later.

Figure 5:
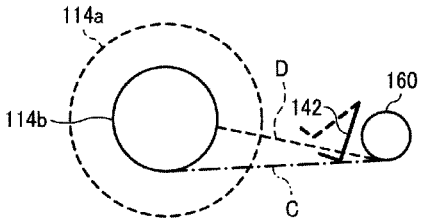
FIG. 5 is a schematic view illustrating a position of a lever included in the bonded-trailing end detector illustrated in FIG. 4.

A description is now given of the position of the lever 142 with reference to both FIGS. 4 and 5. FIG. 5 is a schematic view illustrating the position of the lever 142.

Each of a bonded and unbonded sheet roll with a 3-inch core or a 2-inch core can be set in the image forming apparatus 100. Of these, the unbonded sheet roll with the 2-inch core has the minimum diameter.

In FIG. 5, reference numerals 114*a* and 114*b* denote a 3-inch core and a 2-inch core of the sheet roll 112, respectively. Both the cores 114*a* and 114*b* have the center at the same position above the lowest part of an outer circumference of the driven roller 160. When being positioned at the end line D, the sheet 120 is stretched taut between the center of the core 114*a* or 114*b* and the lowest part of the outer circumference of the driven roller 160. Therefore, the sheet 120 has substantially the same end line D in the case of both the bonded sheet rolls 112 with the 2-inch and 3-inch cores, respectively.

It is to be noted that the line A in FIG. 4 represents a state of the sheet 120 during the normal sheet feeding from the bonded or unbonded sheet roll 112 with the 3-inch core, a line B represents a state of the sheet 120 when the trailing end of the sheet roll 112 is separated from the 3-inch core 114*a* of the unbonded sheet roll 112, and a line E represents a state of the sheet 120 during normal sheet feeding from the bonded or unbonded sheet roll 112 with the 2-inch core.

The line C in FIG. 4 represents a state of the sheet 120 when the trailing end of the sheet roll 112 is separated from the 2-inch core 114*b* of the unbonded sheet roll 112. In other words, the line C connects the lowest part of the outer circumference of the driven roller 160 and the lowest part of an outer circumference of the 2-inch core 114*b* of the unbonded sheet roll 112, which is the minimum size of the sheet roll usable in the image forming apparatus 100.

In the first illustrative embodiment, the lever 142 is disposed such that the detection member 144 of the lever 142 is positioned between the end line D and the line C.

In a case in which the detection member 144 of the lever 142 is disposed near the line C, the trailing end of the unbonded sheet roll 112 with the 2-inch core may be inadvertently moved upward and thus possibly push the detection member 144 upward when being separated from the 2-inch core 114*b* of the unbonded sheet roll 112. When the lever 142 is inadvertently pushed upward as described above, the trailing end of the bonded sheet roll 112 with the 2-inch core or the 3-inch core is erroneously detected.

Therefore, in the present illustrative embodiment, the trailing end of the bonded sheet roll 112 with a 2-inch core or a 3-inch core is detected when the lever 142 is rotated upward above the line C, which connects the lowest part of the outer circumference of the driven roller 160 and the lowest part of the outer circumference of the 2-inch core 114*b* of the unbonded sheet roll 112.

By contrast, the trailing end of the unbonded sheet roll 112 with a core of any size is positioned at or below the line C and thus does not contact the lever 142, thereby preventing erroneous detection of the trailing end of the sheet roll 112. Thus, the trailing end of the bonded sheet roll 112 can be reliably detected.

In some cases, the trailing end of the sheet roll 112 is provisionally bonded to the core 114. In such cases, the trailing end of the sheet 112 is moved slightly above the line C when being separated from the core 114. Specifically, the trailing end of the sheet roll 112, which is provisionally bonded to the core 114, is moved upward while stretched taut between the core 114 and the driven roller 160, and therefore, it is separated from the core 114 while being moved upward and then moved toward the driven roller 160. At this time, the trailing end of the sheet roll 112 is moved upward more than in a case of the unbonded sheet roll 112.

In order to prevent the trailing end of the sheet roll 112 provisionally bonded to the core 114 from being detected erroneously as the trailing end of the bonded sheet roll 112, it is preferable that the trailing end of the bonded sheet roll 112 be detected when the lever 142 is pushed upward above an intermediate position between the end line D and the line C. As a result, the trailing end of the sheet roll 112 provisionally bonded to the core 114 is prevented from being erroneously detected as the trailing end of the bonded sheet roll 112.

Figure 6:
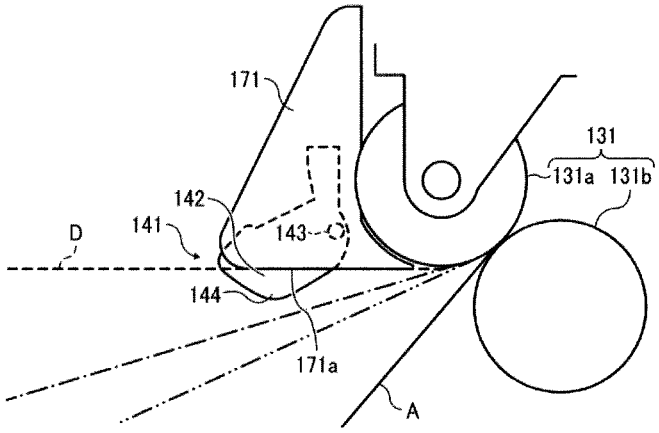
FIG. 6 is an enlarged partial view illustrating an example of a configuration of a bonded-trailing end detector according to a second illustrative embodiment.

It is to be noted that, in the above-described example, the driven roller 160 is provided between the sheet roll 112 and the pair of conveyance rollers 131. However, in a case in which the driven roller 160 is not provided, an upper roller in the pair of conveyance rollers 131, that is, a conveyance roller 131*a*, is provided at the extreme upstream side among the components that contact and convey the sheet 120, as shown in FIG. 6. Alternatively, a guide member that contacts and conveys the sheet 120 may be provided at the extreme upstream side in place of the driven roller 160.

Figure 7:
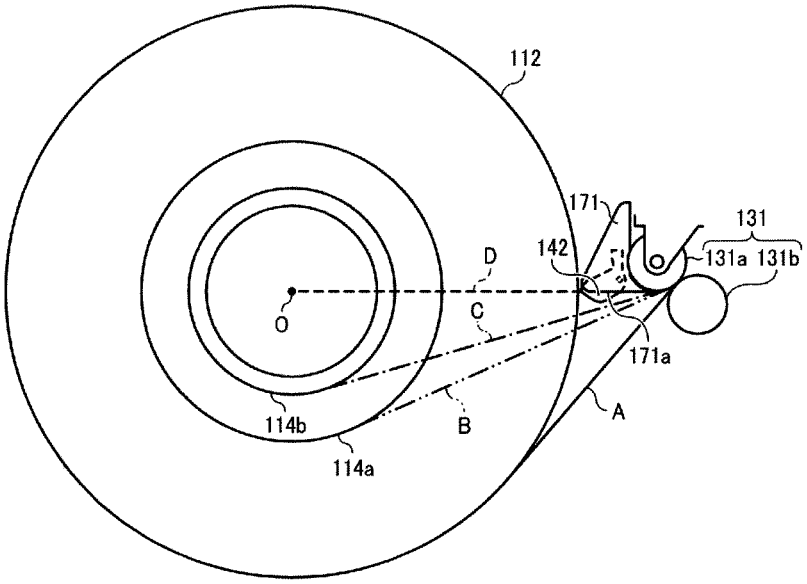
FIG. 7 is a schematic view illustrating states of a sheet fed from a sheet roll according to the second illustrative embodiment.

A description is now given of a second illustrative embodiment of the present invention, with reference to FIGS. 6 and 7. FIG. 6 is an enlarged partial view illustrating an example of a configuration of the bonded-trailing end detector 141 according to the second illustrative embodiment. FIG. 7 is a schematic view illustrating states of the sheet 120 fed from the sheet roll 112 to the pair of conveyance rollers 131 according to the second illustrative embodiment. It is to be noted that the lines A to D in FIGS. 6 and 7 indicate the same states of the sheet 120 as those shown in FIGS. 4 and 5 of the first illustrative embodiment, respectively.

In the second illustrative embodiment, a guide member 171 having a guide surface 171*a* that guides the leading end of the sheet roll 112 upon setting of the sheet roll 112 in the image forming apparatus 100 is provided upstream from the conveyance roller 131*a* of the pair of conveyance rollers 131. It is to be noted that a lower roller of the pair of conveyance rollers 131, that is, an opposing roller 131*b*, is provided opposite the conveyance roller 131*a*.

The guide surface 171*a* of the guide member 171 is shaped such that the leading end of the sheet roll 112 is guided horizontally to the lowest part of an outer circumference of the conveyance roller 131*a*, and is positioned substantially at the same height as the lowest part of the outer circumference of the conveyance roller 131*a*.

The lever 142 of the bonded-trailing end detector 141 is rotatably held by the guide member 171, and the detection member 144 of the lever 142 protrudes beyond the guide surface 171*a* of the guide member 171.

As illustrated in FIG. 7, the sheet roll 112 is set such that the center of rotation O is positioned below or at the same height as both the lowest edge of the guide surface 171*a* and the lowest part of the outer circumference of the conveyance roller 131*a*.

Thus, during normal sheet feeding, the sheet 120 is guided from the outer circumference of the sheet roll 112 to the pair of conveyance rollers 131 along the line A in FIGS. 6 and 7 so that the detection member 144 of the lever 142 does not contact the sheet 120.

As the sheet roll 112 approaches its end, the position of the sheet 120 extended between the outer circumference of the sheet roll 112 and the pair of conveyance rollers 131 shifts upward. When the sheet roll 120 reaches its end, the bonded position where the trailing end of the sheet roll 112 is bonded to the core 114 is moved upward and thus the sheet 120 is positioned at the end line D above the line C in FIGS. 6 and 7.

As a result, the detection member 144 of the lever 142 is pushed upward, detecting the trailing end of the bonded sheet roll 112.

In the second illustrative embodiment, the guide member 171 is provided upstream from the pair of conveyance rollers 131. In addition, the center of rotation O of the sheet roll 112 (or the core 114) is positioned below or at the same height as both the lowest edge of the guide surface 171*a* and the lowest part of the outer circumference of the conveyance roller 131*a*.

As a result, the guide member 171 is positioned at the same height as the lowest part of the outer circumference of the conveyance roller 131*a*.

Figure 8:
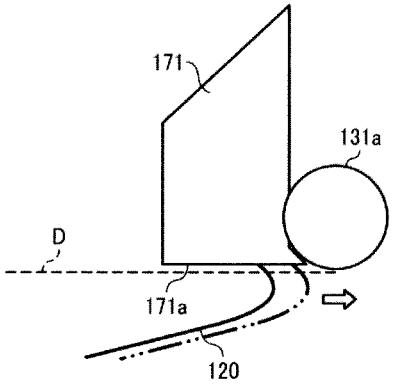
FIG. 8 is a schematic view illustrating states of a leading end of the sheet upon setting of the sheet roll according to the second illustrative embodiment.

In general, the sheet 120 is curled up in a direction of winding around the core 114. Curl up at the leading end of the sheet 120 often causes irregular setting of the sheet roll 112. However, in the second illustrative embodiment, the guide member 171 is positioned at the same height as the lowest part of the conveyance roller 131*a* so that, even when being curled up, the leading end of the sheet 120 is reliably guided to the conveyance roller 131*a* along the guide surface 171*a* of the guide member 171 upon setting of the sheet roll 112 as illustrated in FIG. 8. Accordingly, the leading end of the sheet roll 112 can be prevented from being bent upon setting of the sheet roll 112, thereby facilitating setting of the sheet roll 112 in the image forming apparatus 100.

By contrast, if the center of rotation O of the sheet roll 112 is positioned above both the guide surface 171*a* of the guide member 171 and the lowest part of the conveyance roller 131*a*, the leading end of the sheet roll 112 is detected when the sheet 120 is positioned at the end line D of the first illustrative embodiment as illustrated in FIG. 4. Therefore, in such a case, the guide surface 171*a* of the guide member 171 must be positioned above the end line D as illustrated in FIG. 9.

Figure 9:
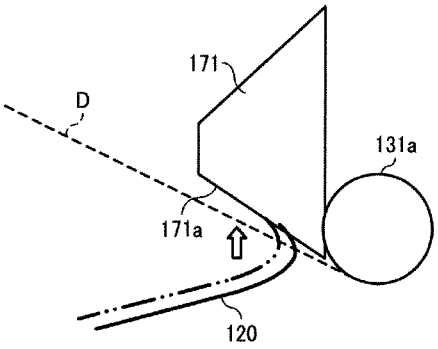
FIG. 9 is a schematic view illustrating states of a leading end of a sheet upon setting of a sheet roll according to a comparative example.

Consequently, when the sheet roll 112 having the curled-up leading end is set, the leading end is guide upward along the guide surface 171*a* in a direction opposite the direction of conveyance of the sheet 120 as illustrated in FIG. 9, thereby preventing the leading end of the sheet roll 112 from being properly guided to the conveyance roller 131*a*.

In order to reliably detect the bonded-trailing end of the sheet roll 112 using the bonded-trailing end detector 141 and to guide the leading end of the sheet roll 112 to the pair of conveyance rollers 131 using the guide member 171, the center of rotation O of the sheet roll 112 needs to be positioned below or at the same height as both the lowest edge of the guide surface 171*a* and the lowest part of the outer circumference of the conveyance roller 131*a*.

In addition, the bonded-trailing end detector 141 is mounted on the guide member 171 to accurately detect the trailing end of the sheet roll 112 guided along the guide member 171. As a result, provision of a separate member that holds the bonded-trailing end detector 141 is not needed, thereby reducing production costs.

Figure 10:
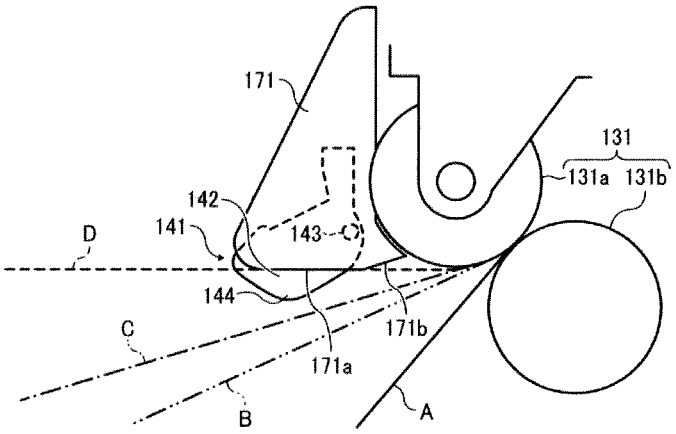
FIG. 10 is an enlarged partial view illustrating an example of a configuration of a bonded-trailing end detector according to a third illustrative embodiment.
Figure 11:
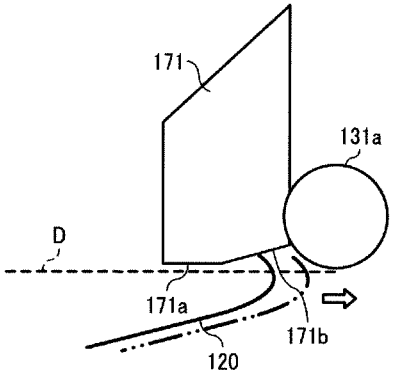
FIG. 11 is a schematic view illustrating states of a leading end of a sheet upon setting of a sheet roll according to the third illustrative embodiment.

A description is now given of a third illustrative embodiment of the present invention, with reference to FIGS. 10 and 11. FIG. 10 is an enlarged partial view illustrating an example of a configuration of the bonded-trailing end detector 141 according to the third illustrative embodiment. FIG. 11 is a schematic view illustrating states of the leading end of the sheet 120 upon setting of the sheet roll 112 in the image forming apparatus 100 according to the third illustrative embodiment. It is to be noted that the lines A to D in FIGS. 10 and 11 indicate the same states of the sheet 120 as those shown in FIGS. 4 and 5 of the first illustrative embodiment, respectively.

In the third illustrative embodiment, the guide member 171 further has a sloped surface 171*b* provided downstream from the guide surface 171*a*. The sloped surface 171*b* slopes upward from upstream to downstream in the direction of conveyance of the sheet 120.

As a result, when the sheet roll 112 is set in the image forming apparatus 100, the curled-up leading end of the sheet roll 112 is more easily guided to the pair of conveyance rollers 131 by the sloped surface 171*b* of the guide member 171, thereby further facilitating setting of the sheet roll 112 in the image forming apparatus 100.

In particular, the leading end of a stiff sheet roll 112 wound around the 2-inch core tends to be curled up.

The foregoing illustrative embodiments are applicable not only to the serial-type image forming apparatuses but also to line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A sheet feeder, comprising:

a sheet roll constituted of one long continuous sheet wound, starting with a trailing end of the sheet roll, around a core;

a sheet conveyance unit including one or more conveyance members to convey in a conveyance direction the sheet fed from the sheet roll, and a contact member that is upstream, in the conveyance direction, of the conveyance members and contacts at a contact point to an upper surface of the sheet fed from the sheet roll;

a trailing end detector which (i) is rotatable about a rotary shaft that is disposed at a position closer to the sheet conveyance unit than to the sheet roll and (ii) is disposed to contact an upper surface of the sheet extended between the core of the sheet roll and the contact member when the sheet is guided by the contact member upward in the conveyance direction, the trailing end detector detecting the trailing end of the sheet roll upon being rotated upward by displacement of the upper surface of the sheet to a position above a notional line connecting the contact point of the contact member and a lowest part of the outer circumference of the core; and a support member that supports both of the contact member and the trailing end detector.

2. The sheet feeder according to claim 1, wherein the trailing end detector comprises:

a lever having its center of rotation downstream from the sheet roll in the direction of conveyance of the sheet; and a detection member provided to the lever to contact the sheet at a position upstream from the center of rotation in the direction of conveyance of the sheet.

3. The sheet feeder according to claim 1, wherein the trailing end detector is provided to the support member.

4. The sheet feeder according to claim 1, wherein:

the sheet conveyance unit further comprises a pair of rotary bodies that sandwich the sheet to convey the sheet;

the sheet feeder comprises a guide member provided upstream from the pair of rotary bodies in the direction of conveyance of the sheet and having a guide surface to guide the sheet; and a center of rotation of the sheet roll is provided at or below a position of both an upper rotary body in the pair of rotary bodies and the guide surface of the guide member.

5. The sheet feeder according to claim 4, wherein the guide surface of the guide member extends horizontally and is provided upstream from the pair of rotary bodies in the direction of conveyance of the sheet, the guide member farther comprising a sloped surface provided downstream from the guide surface and sloping upward from upstream to downstream in the direction of conveyance of the sheet toward the upper rotary body in the pair of rotary bodies.

6. The sheet feeder according to claim 4, wherein the trailing end detector is provided to the guide member.

7. An image forming apparatus comprising:

an image forming unit to form an image on a recording medium fed thereto; and a sheet feeder to feed the recording medium to the image forming unit, wherein the sheet feeder comprises:

a sheet roll constituted of one long continuous sheet wound, starting with a trailing end of the sheet roll, around a core;

a sheet conveyance unit including one or more conveyance members to convey in a conveyance direction the sheet fed from the sheet roll, and a contact member that is upstream, in the conveyance direction, of the conveyance members and contacts at a contact point to an upper surface of the sheet fed from the sheet roll;

a trailing end detector which (i) is rotatable about a rotary shaft that is disposed at a position closer to the sheet conveyance unit than to the sheet roll and (ii) is disposed to contact an upper surface of the sheet extended between the core of the sheet roll and the contact when the sheet is guided by the contact member upward in the conveyance direction, the trailing end detector detecting the trailing end of the sheet roll upon being rotated upward by displacement of the upper surface of the sheet to a position above a notional line connecting the contact point of the contact member and a lowest part of the outer circumference of the core; and a support member that supports both of the contact member and the trailing end detector.

* * * * *